US008640483B2

(12) United States Patent
Chase et al.

(10) Patent No.: US 8,640,483 B2
(45) Date of Patent: Feb. 4, 2014

(54) ICE GUIDE FUNNEL

(75) Inventors: Kevin M. Chase, Saint Joseph, MI (US); Tony L. Koenigsknecht, Austin, TX (US); Jerold M. Visin, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 277 days.

(21) Appl. No.: 12/636,988

(22) Filed: Dec. 14, 2009

(65) Prior Publication Data

US 2011/0139304 A1 Jun. 16, 2011

(51) Int. Cl.
*F25C 5/18* (2006.01)
*B65D 88/26* (2006.01)

(52) U.S. Cl.
USPC ..... 62/344; 62/377; 222/460

(58) Field of Classification Search
USPC ..... 62/344, 377; 222/462, 460; 141/331
See application file for complete search history.

(56) References Cited

U.S. PATENT DOCUMENTS 1,007,401 A * 10/1911 Stata ..... 210/251
1,660,442 A * 2/1928 Hampton ..... 137/147
3,537,132 A 11/1970 Alvarez
3,537,273 A 11/1970 Alvarez
3,572,053 A 3/1971 Jacobus
3,640,088 A 2/1972 Jacobus et al.
3,789,620 A 2/1974 Benasutti
4,069,545 A 1/1978 Holet
4,102,660 A 7/1978 Beckett et al.
4,153,183 A * 5/1979 Chatman ..... 222/181.2
4,209,999 A 7/1980 Falk
4,220,266 A 9/1980 Braden
4,555,049 A 11/1985 Mawby
4,679,715 A 7/1987 Hovinga
4,981,237 A 1/1991 Landers
5,029,737 A 7/1991 Yamamoto
5,033,521 A * 7/1991 Martin ..... 141/337
5,054,654 A 10/1991 Schroeder
5,104,007 A 4/1992 Utter
5,148,842 A 9/1992 Boust
5,188,157 A * 2/1993 Lee ..... 141/338
5,429,269 A 7/1995 Mejias
5,442,933 A 8/1995 Unger
5,473,911 A 12/1995 Unger
5,474,213 A 12/1995 Unger
5,526,854 A 6/1996 Unger
5,860,564 A 1/1999 Jablonski
6,135,173 A 10/2000 Lee
6,158,564 A 12/2000 Derelanko
6,267,272 B1 7/2001 Shin
6,533,003 B1 3/2003 Jacobus
6,648,187 B1 11/2003 Shypkowski
7,007,500 B2 3/2006 Lee
7,325,408 B2 2/2008 Lim
7,340,914 B2 3/2008 Bowen et al.
2006/0201192 A1 9/2006 Bowen
2006/0201194 A1 9/2006 Bowen
2007/0119193 A1 5/2007 Davis
2007/0271949 A1 11/2007 Lee et al.
2007/0289669 A1 12/2007 An
2010/0089493 A1 * 4/2010 Seo ..... 141/351

* cited by examiner

*Primary Examiner* — Lakiya Rogers

(57) ABSTRACT

An appliance dispenser includes a housing defining a recess. The housing includes a receptacle support member and a fixed funnel. An ice dispensing passage extends through the fixed funnel and operably connected with an ice bin. A variable funnel includes a proximal end and a distal end. The proximal end is adjacent the fixed funnel. The distal end is movable between a retracted position and an extended position.

14 Claims, 12 Drawing Sheets

ICE GUIDE FUNNEL

BACKGROUND OF THE PRESENT INVENTION

The present invention generally relates to an ice guide-funnel, and more specifically, to an ice guide funnel operable between retracted and extended positions.

SUMMARY OF THE INVENTION

In one aspect of the present invention, an appliance dispenser includes a housing defining a recess. The housing includes a receptacle support member and a fixed funnel. An ice dispensing passage extends through the fixed funnel and operably connects with an ice bin. The appliance dispenser also includes a variable funnel that includes a proximal end and a distal end. The proximal end is adjacent the fixed funnel. The distal end is movable between a retracted position and an extended position.

In another aspect of the present invention, an appliance includes an ice bin. A dispenser is adjacent to the ice bin and includes a fixed funnel that extends from the dispenser. The dispenser also includes an extendable funnel that is adjacent to the fixed funnel and adapted to be extended to a first position and retracted to a second position. An ice dispensing passage extends from the ice maker through the fixed funnel and extendable funnel. The ice dispensing passage lengthens when the extendable funnel moves from the first position to the second position.

In yet another aspect of the present invention, a dispenser for use on an appliance includes a housing defining a recess. The housing includes a receptacle support member and a first funnel. An ice dispensing passage extends through the first funnel and into operable connection with an ice maker. A second funnel includes a distal end and is operable between an extended position and a retracted position. The distal end of the second funnel is closer to the first funnel when in the retracted position then when in the extended position.

These and other features, advantages, and objects of the present invention will be further understood and appreciated by those skilled in the art upon studying the following specification, claims, and appended drawings.

DETAILED DESCRIPTION OF EMBODIMENTS

Figure 1:
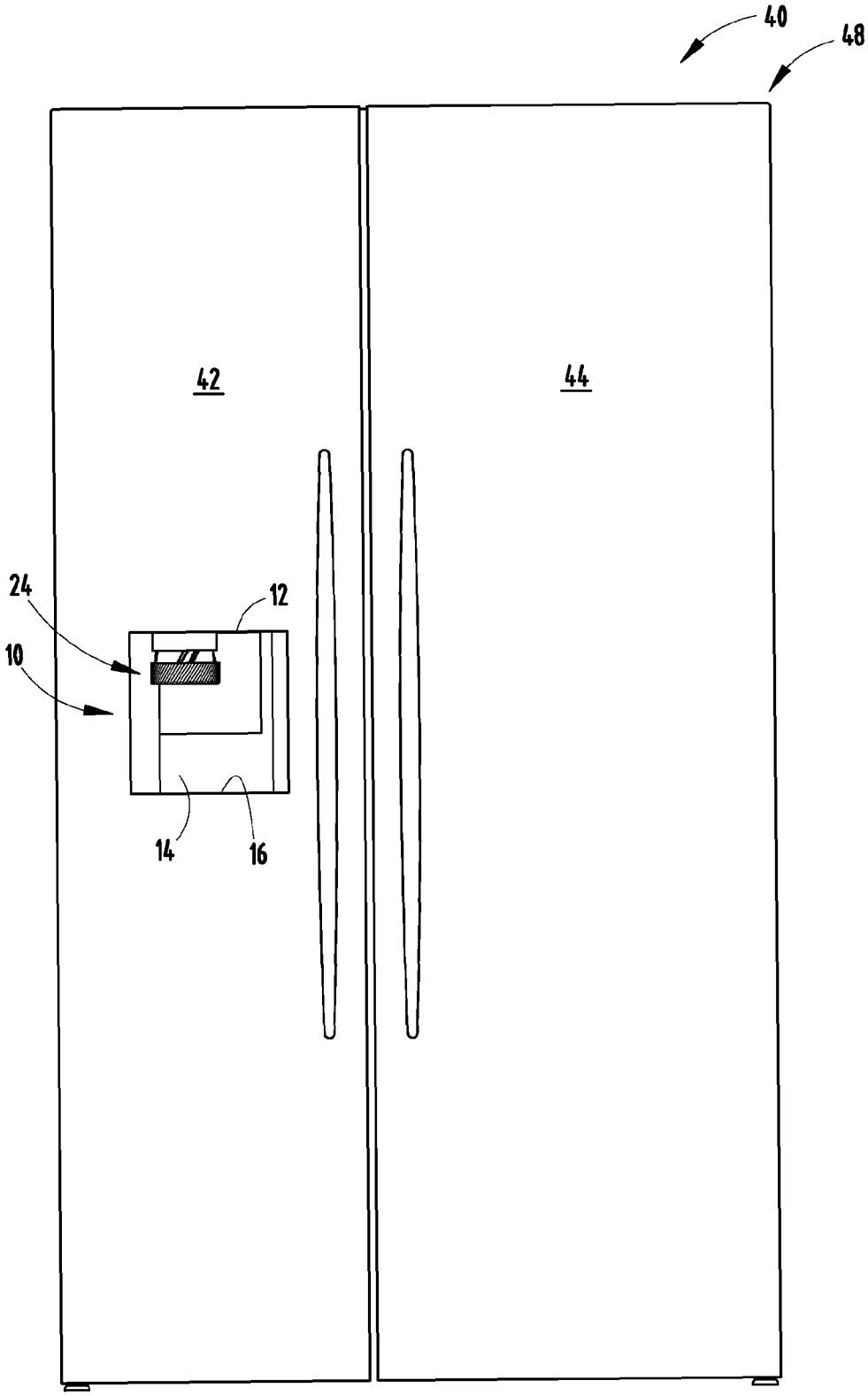
FIG. 1 is a front elevational view of a refrigerator incorporating one embodiment of an ice guide funnel of the present invention.
Figure 3:
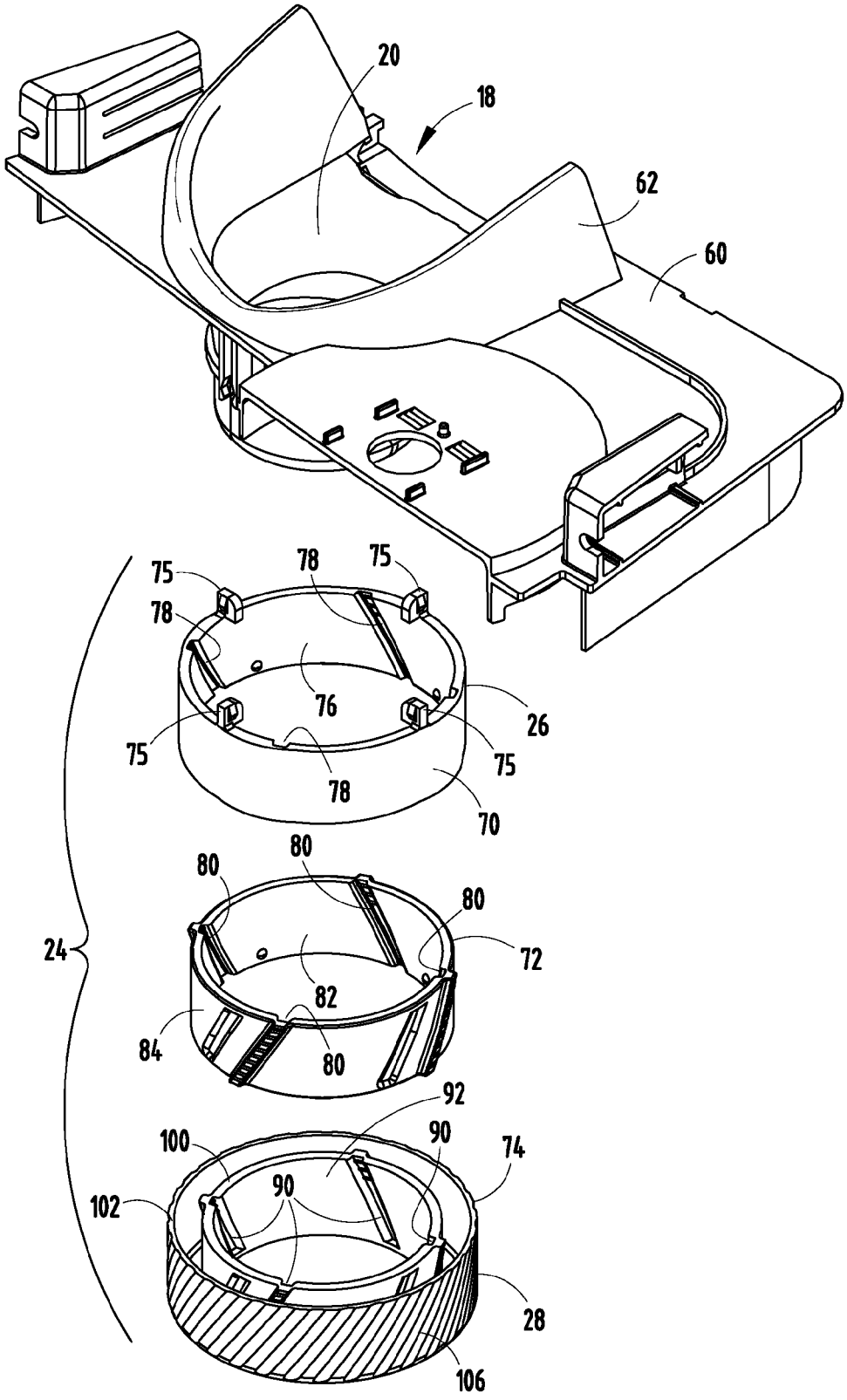
FIG. 3 is a top perspective exploded view of one embodiment of the ice guide funnel.

For purposes of description herein the terms "upper," "lower," "right," "left," "rear," "front," "vertical," "horizontal," and derivatives thereof shall relate to the invention as oriented in FIGS. 1 and 3. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
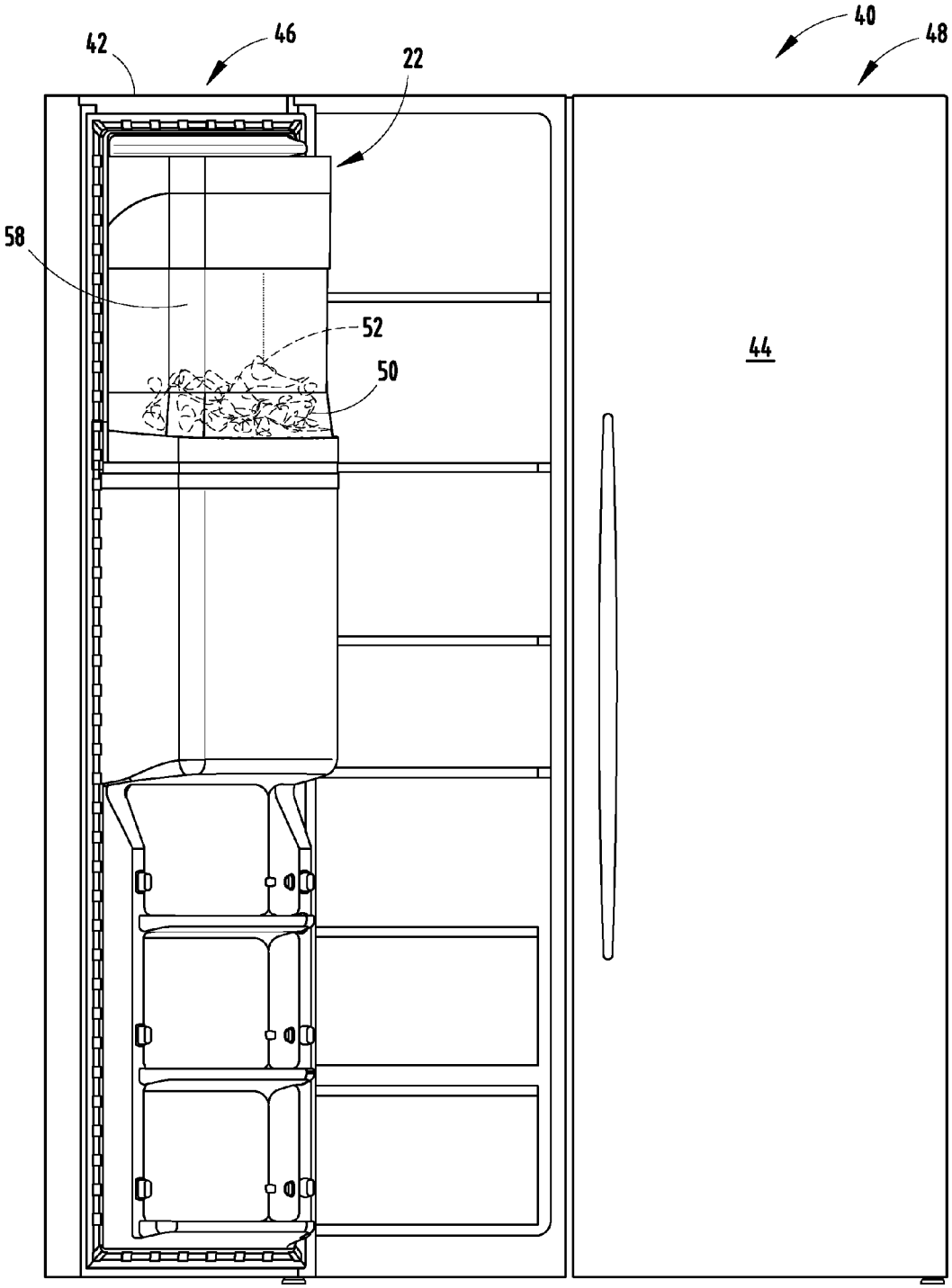
FIG. 2 is the refrigerator of FIG. 1 with a freezer side door open.
Figure 8:
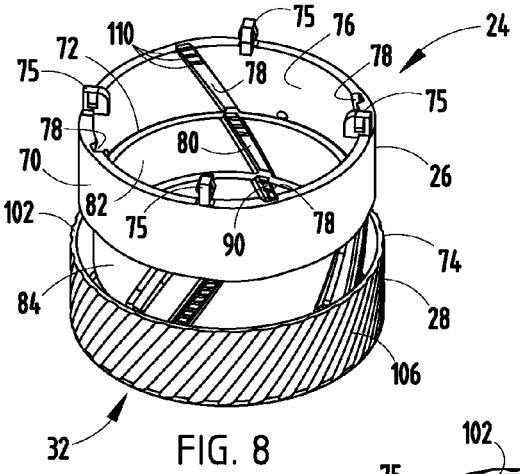
FIG. 8 is a top perspective view of a portion of one embodiment of the funnel in an extended position.
Figure 9:
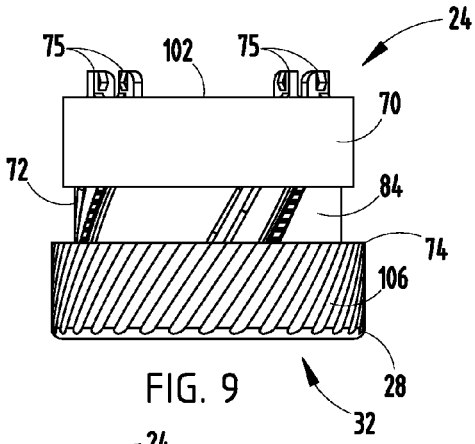
FIG. 9 is a front elevational view of the funnel portion of FIG. 8.
Figure 10:
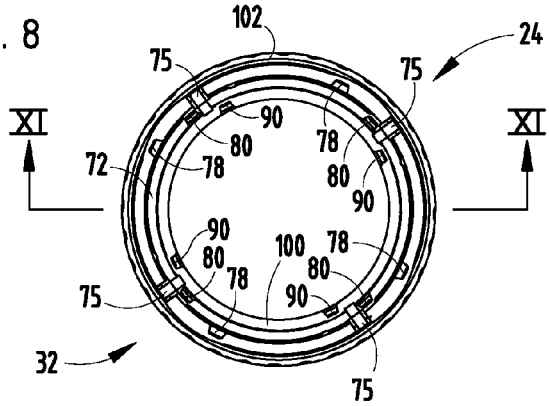
FIG. 10 is a top plan view of the funnel portion of FIG. 8.
Figure 11:
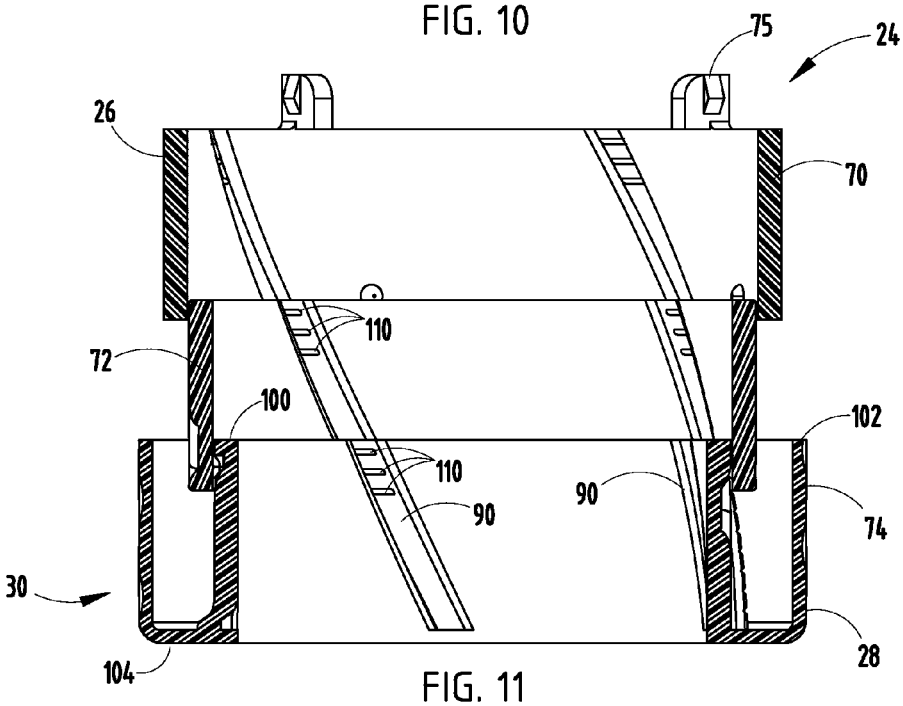
FIG. 11 is a side cross-sectional view of the funnel portion of FIG. 8.
Figure 12:
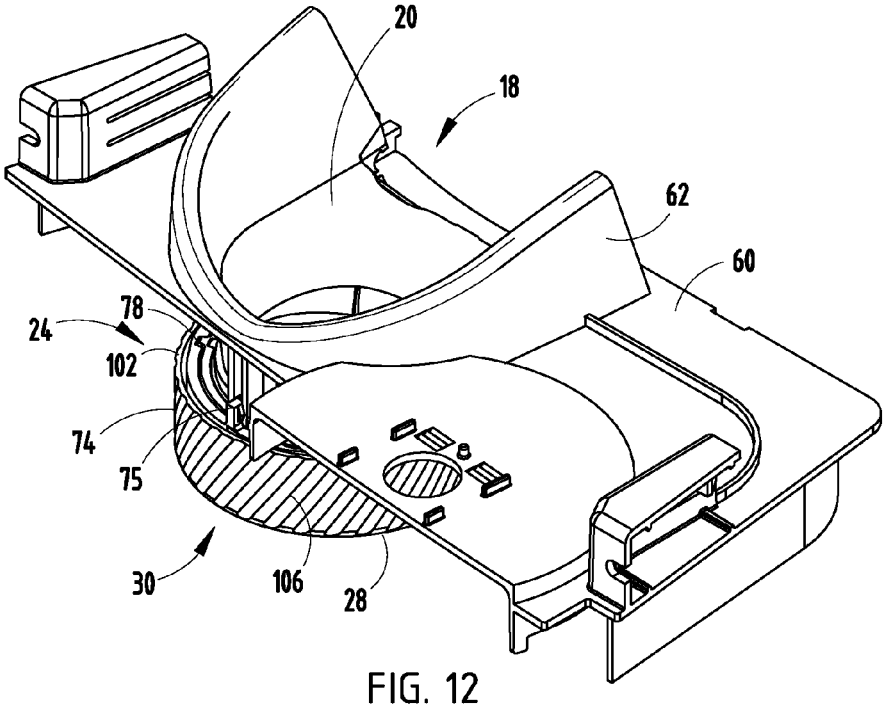
FIG. 12 is a top perspective view of one embodiment of an ice guide funnel of the present invention.
Figure 13:
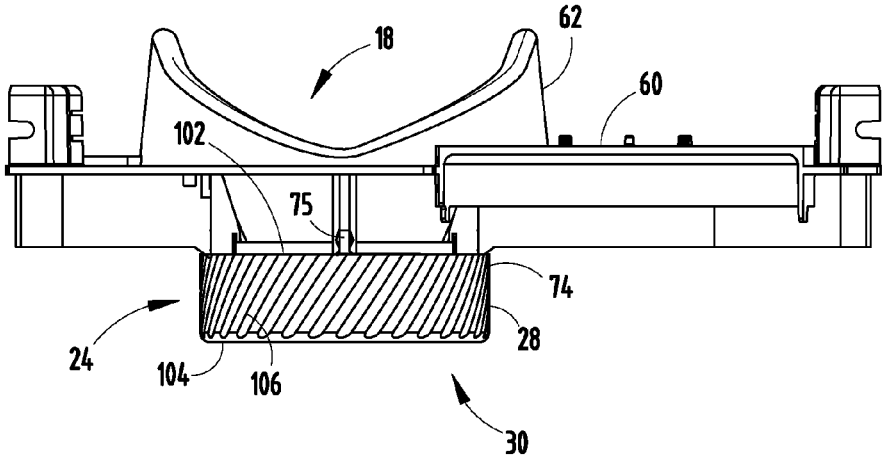
FIG. 13 is a front elevational view of the ice guide funnel of FIG. 12.
Figure 14:
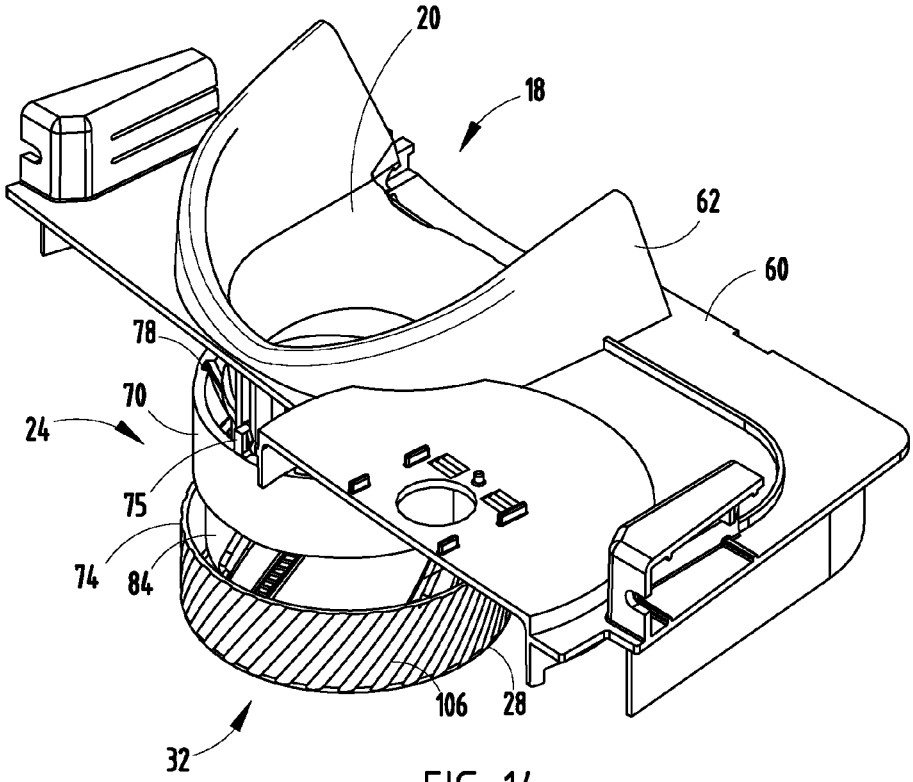
FIG. 14 is a top perspective view of the ice guide funnel of FIG. 12 with a portion of the funnel in an extended position.
Figure 15:
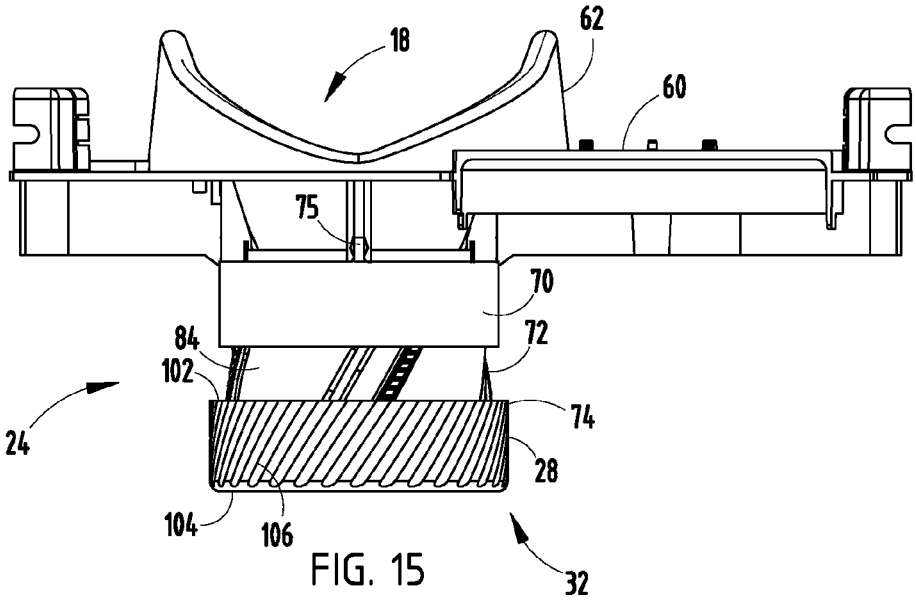
FIG. 15 is a front elevational view of the ice guide funnel of FIG. 14.

Referring to the embodiment illustrated in FIGS. 1-3, the reference numeral 10 generally designates an appliance dispenser having a housing 12 defining a recess 14. The housing 12 includes a receptacle support 16 and a fixed funnel 18. An ice dispensing passage 20 extends through the fixed funnel 18 and is operably connected with an ice maker 22. A variable funnel 24 includes a proximal end 26 and a distal end 28. The proximal end 26 is adjacent the fixed funnel 18. The distal end 28 is movable between a retracted position 30 (FIG. 4) and an extended position 32 (FIG. 8).

Figure 16:
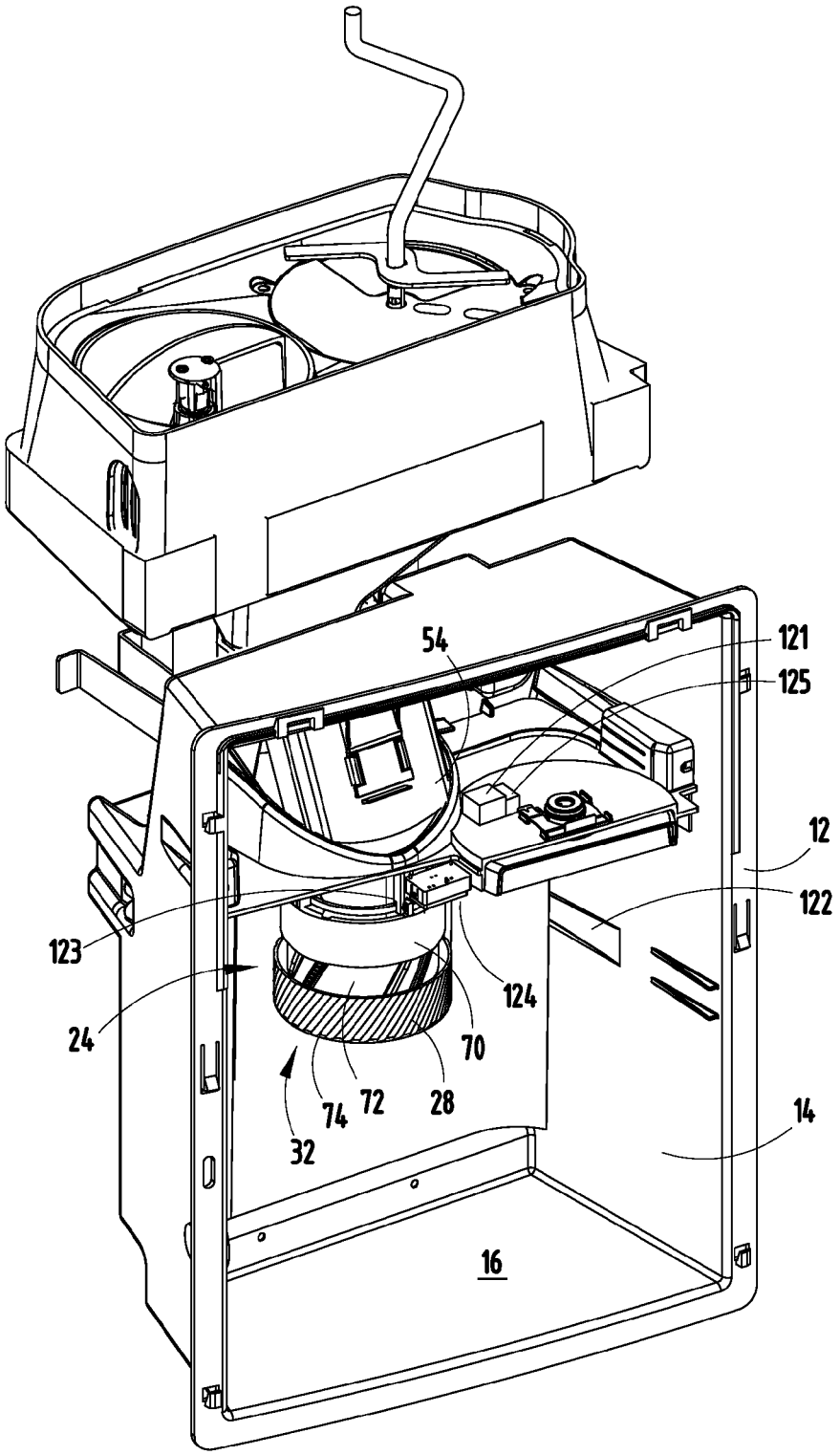
FIG. 16 is a top perspective view of the ice guide funnel installed in an ice dispensing apparatus of a refrigerator.

Referring again to FIGS. 1-3, the appliance dispenser 10 is generally installed in an appliance, such as a refrigerator 40 (FIG. 1). The refrigerator 40 includes first and second doors 42, 44 operable between open and closed positions 46, 48, which keep contents disposed in the refrigerator 40 in a refrigerated or frozen state. An ice bin 50 is disposed inside the refrigerator 40, the contents of which are accessible from inside the refrigerator 40, or from outside the refrigerator 40 through the appliance dispenser 10. To actuate the dispenser 10 and access ice 52 from outside the refrigerator 40, a trap door 54 (FIG. 16) disposed below the dispenser 10 is opened. The dispenser 10 is positioned below an ice storage unit 58 and, when the trap door 54 opens, ice flows to the fixed funnel 18. When ice 52 reaches the fixed funnel 18, the ice 52 descends through the ice dispensing passage 20 in the fixed funnel 18 and though the variable funnel 24, at which point the ice 52 is dispensed from the refrigerator 40.

Referring to FIGS. 3 and 12-15, the fixed funnel 18 includes a base 60 with an upwardly collection wall 62 that extends around the ice dispensing passage 20 defined by the fixed funnel 18. The collection wall 62 is designed to guide ice 52 down into the ice dispensing passage 20 and into the variable funnel 24. The fixed funnel 18 is secured to the housing 12 that is disposed in one of the first and second appliance doors 42, 44.

Referring again to the embodiment illustrated in FIG. 3, the variable funnel 24 includes a top annular ring 70, an intermediate annular ring 72, and a bottom annular ring 74. The top annular ring 70 is proximate with and connected to the fixed funnel 18 and does not generally move relative to the fixed funnel 18. The top annular ring 70 includes a plurality of engagement tabs 75 that secure the top annular ring 70 to the fixed funnel 18. An inner circumferential area 76 of the top ring 70 includes a plurality of threads 78 adapted to engage the intermediate annular ring 72, as discussed in more detail below. The threads 78 may be vertically aligned or may be angled (as shown in FIG. 3). The threads 78 allow for vertical translation of the intermediate annular ring 72 relative to the top annular ring 70.

Referring again to the embodiment illustrated in FIG. 3, the intermediate annular ring 72 includes a plurality of threads 80 disposed both on an inner circumferential area 82 of the intermediate annular ring 72 and an outer circumferential area 84 of the intermediate annular ring 72. The threads 80 on the outer circumferential area 84 of the intermediate annular ring 72 slidably engage the threads 78 disposed on the inner circumferential area 76 of the top annular ring 70, which allows for the intermediate annular ring 72 to slide upward and downward relative to the top annular ring 70. The threads 80 disposed on the inner circumferential area 82 of the intermediate annular ring 72 are designed to engage threads 90 disposed on another circumferential area 92 of the bottom annular ring 74. Specifically, the threads 90 disposed on the outer circumferential area 92 of the bottom annular ring 74 slidably engage the threads 80 disposed on the inner circumferential area 82 of the intermediate annular ring 72, allowing for vertical translation of the bottom annular ring 74.

Figure 4:
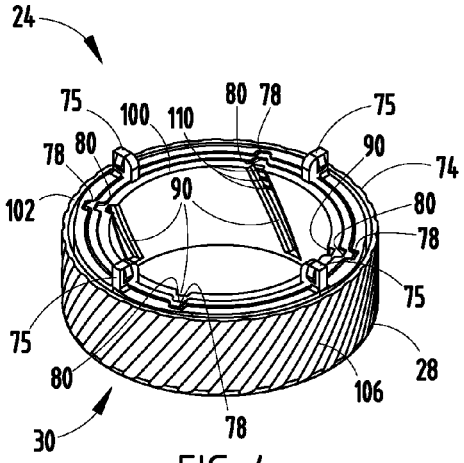
FIG. 4 is a top perspective view of a portion of the ice guide funnel in a retracted position.
Figure 5:
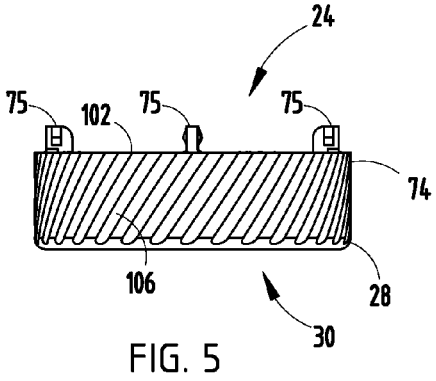
FIG. 5 is a front elevational view of the funnel portion of FIG. 4.
Figure 6:
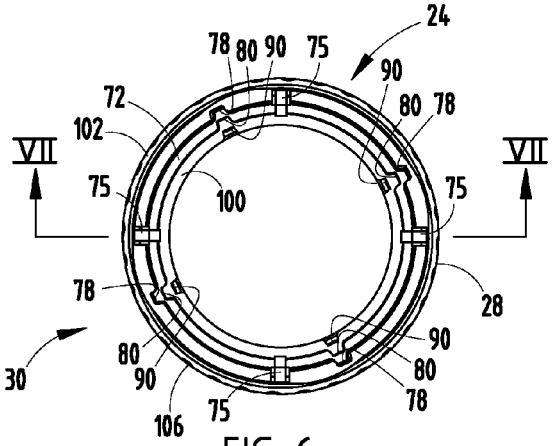
FIG. 6 is a top plan view of the funnel portion of FIG. 4.
Figure 7:
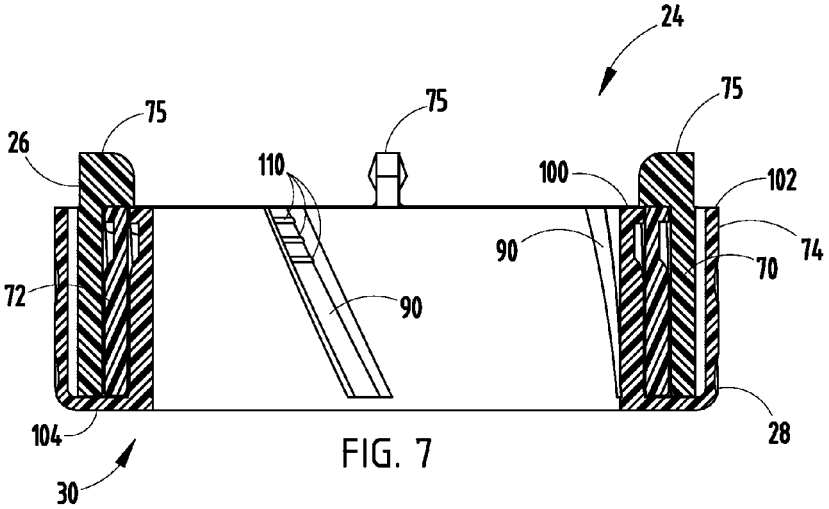
FIG. 7 is a side cross-sectional view of the funnel portion of FIG. 4.

Referring again to the embodiment illustrated in FIG. 3, the bottom annular ring 74 includes an inner portion 100 and an outer portion 102 connected by a bottom wall 104 (FIG. 7). The outer portion 102 is larger than both the intermediate annular ring 72 and the top annular ring 70, and is designed to cover each of the three rings 70, 72, 74 when the variable funnel 24 is in the retracted position 30 (FIG. 4). The outer portion 102 also includes a gripping surface 106 that allows a user to grab the outer portion 102 and pull the outer portion 102 downward in a vertical direction. Depending on the orientation of the threads 78, 80 and 90, it is contemplated that the bottom annular ring 74 may descend linearly relative to the top annular ring 70 or may spiral downward relative to the top annular ring 70. The threads 90 are located on the inner portion 100 and slidably engage the threads 80 of the intermediate annular ring 72. The threads 78, 80, 90 include protrusions 110 (FIG. 7) that frictionally engage to keep the rings 70, 72, 74 of the variable funnel 24 at the retracted position 30 (FIG. 4), extended position 32 (FIG. 8), or a predetermined position therebetween.

Referring now to FIGS. 12-15, the outer portion 102 of the bottom annular ring 74 is positionable over both the intermediate annular ring and the top annular ring when the variable funnel 24 is in the retracted position 30. When in the extended position 32 (FIGS. 14 and 15), each of the top annular ring 70, intermediate annular ring 72, and bottom annular ring 74 are at least partially exposed. As the funnel lengthens, the likelihood of splashing as a result of ice dispensing minimizes due to a more controlled ice drop.

Figure 17:
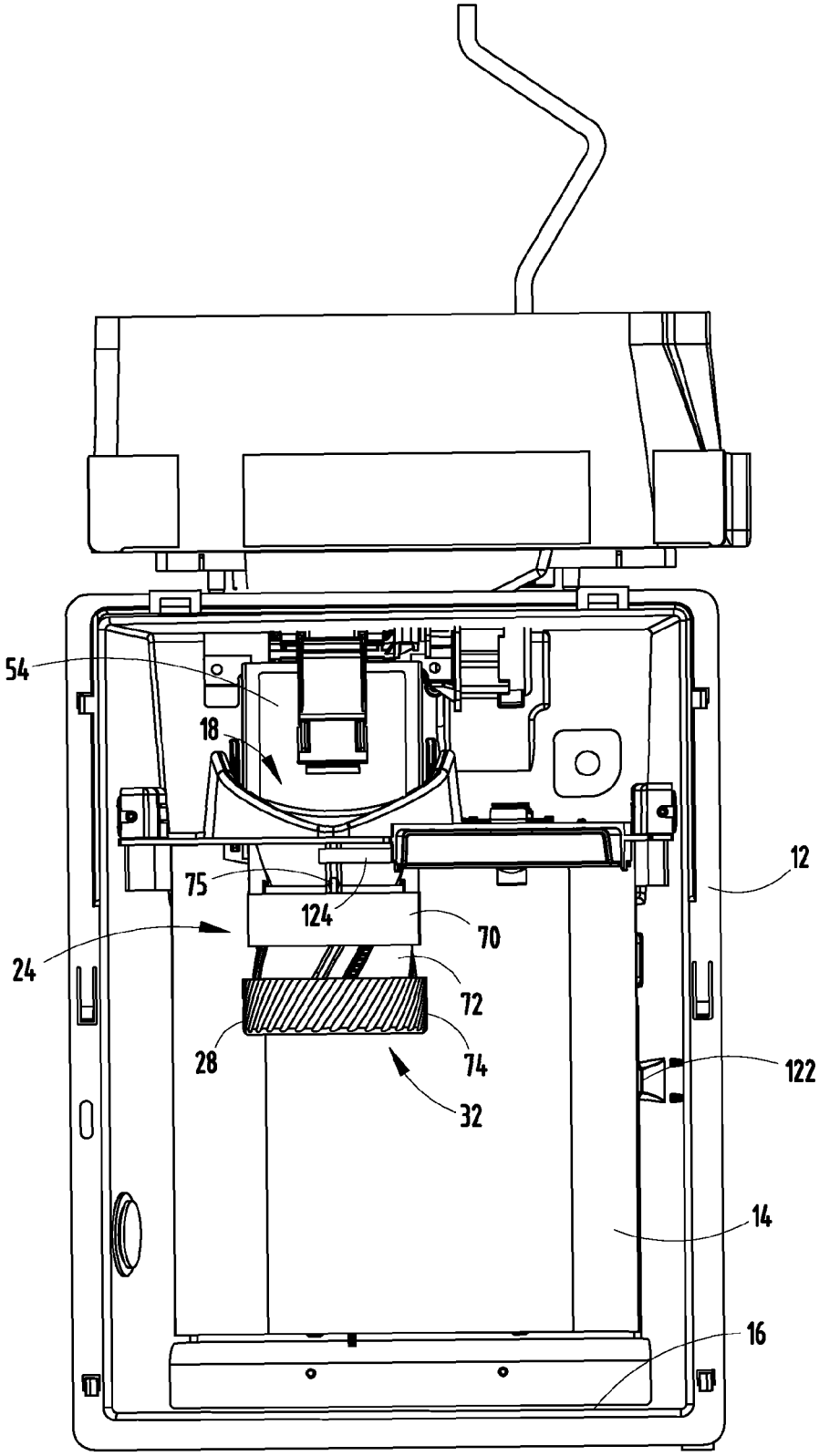
FIG. 17 is a front elevational view of the ice guide funnel installed, as shown in FIG. 16.
Figure 18:
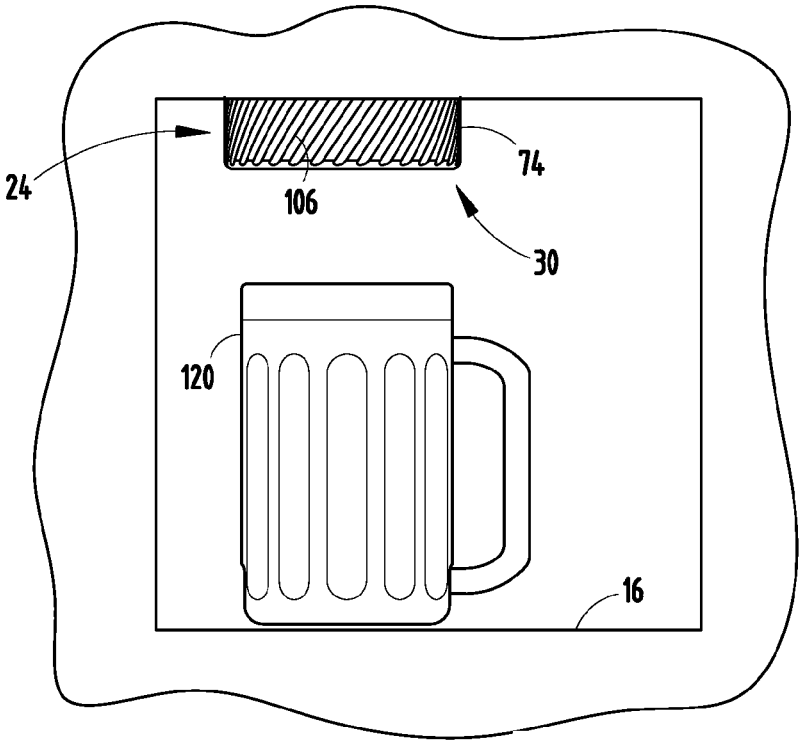
FIG. 18 is a front elevational view of a cup placed underneath the ice guide funnel.
Figure 19:
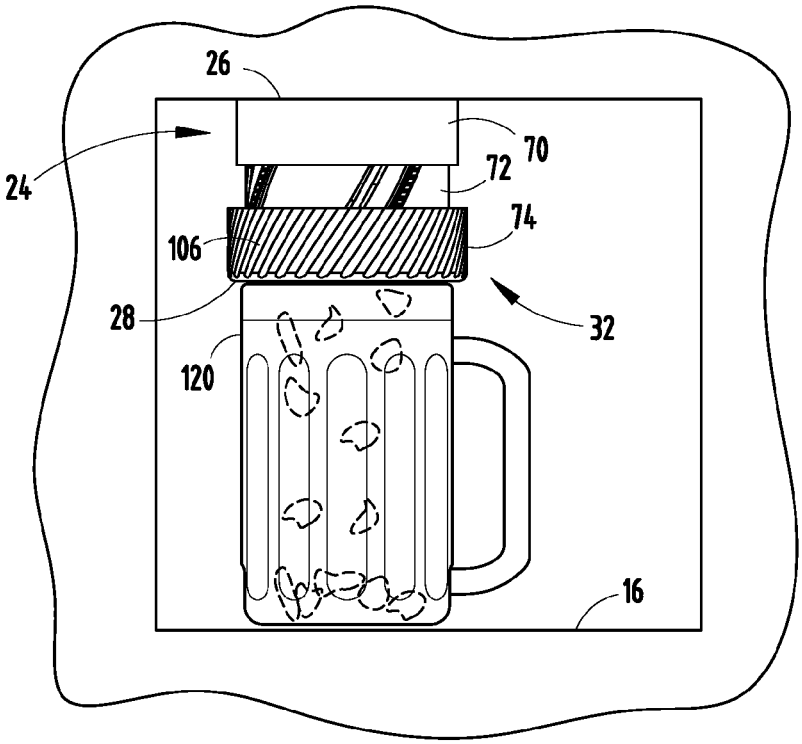
FIG. 19 is a front elevational view of the cup in position to receive ice and with a portion of the ice guide funnel in the extended position.

Referring now to FIGS. 18 and 19, when a user places a cup 120 below the ice dispensing passage and lowers the variable funnel 24, such that the distance between the distal end 28 of the variable funnel 24 and the top of the cup 120 is minimized, the likelihood of splashing is also minimized. It is contemplated that the variable funnel 24 may be secured to a motor 121 or a mechanical device 123 that operably raises and lowers the variable funnel 24 to a position adjacent to or abutting the top of the cup 120. It is also contemplated that an infrared eye 122 (FIG. 17) or other detection device may be used to determine the total distance that the variable funnel should descend before stopping. In another embodiment, a pressure sensor 124 (FIG. 17) detects when the distal end of the variable funnel 24 contacts the top of the cup 120.

Figure 20:
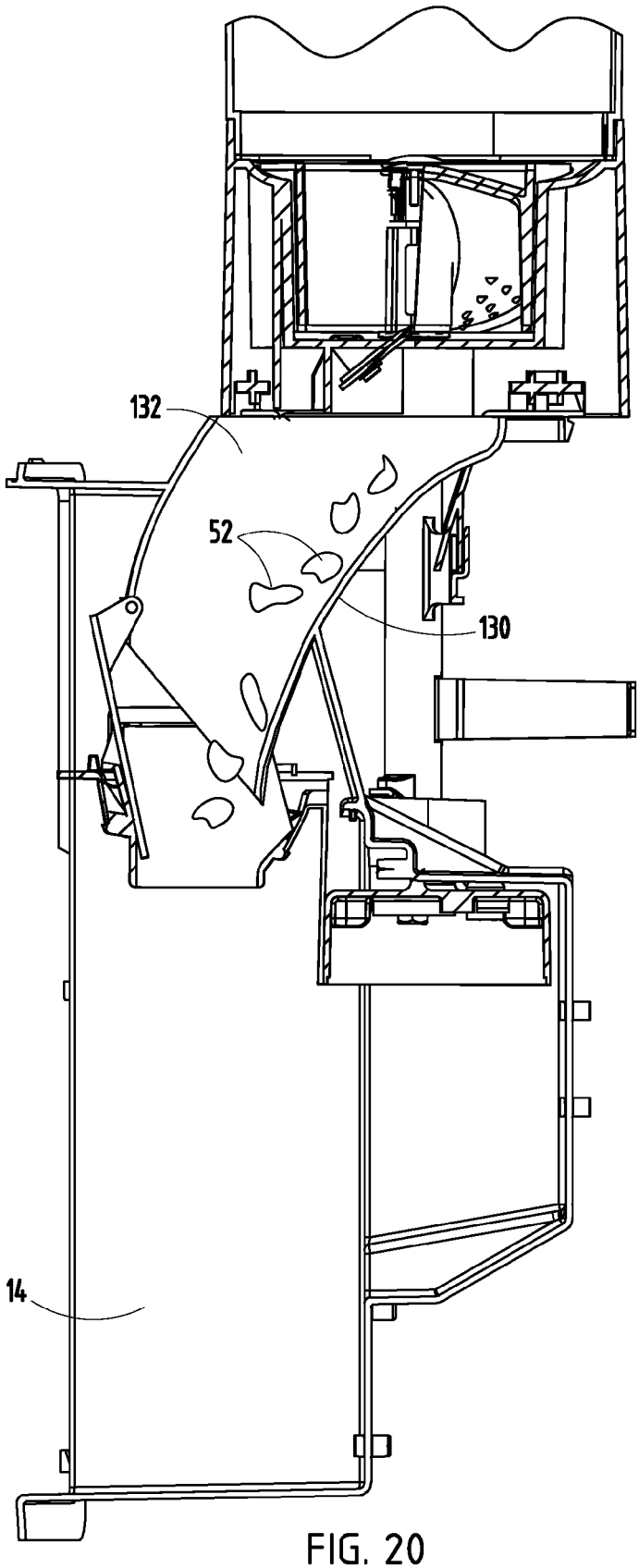
FIG. 20 is a side cross-sectional view of one embodiment of a vertical ice chute of the present invention.
Figure 21:
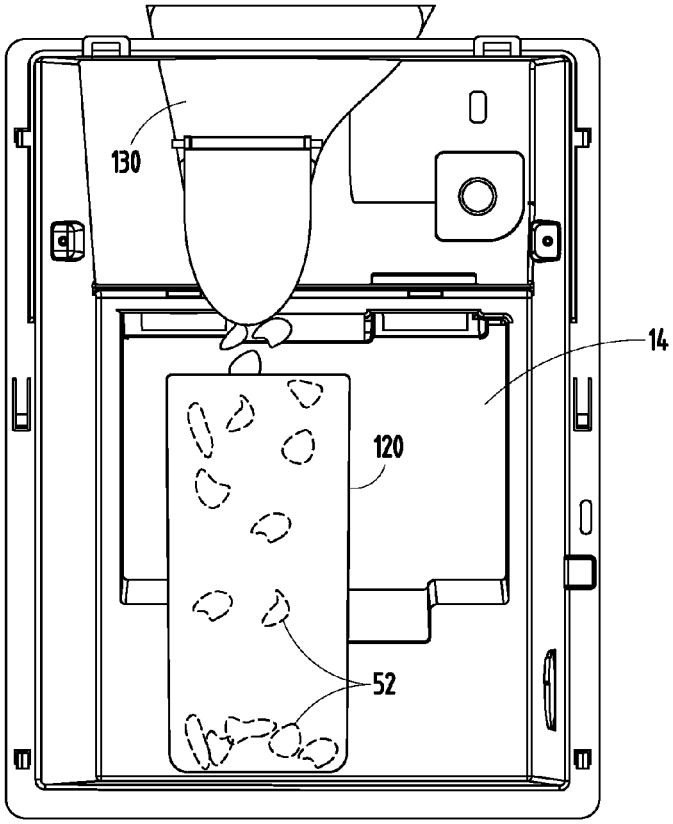
FIG. 21 is a front elevational view of a cup receiving ice from a vertical ice chute.
Figure 22:
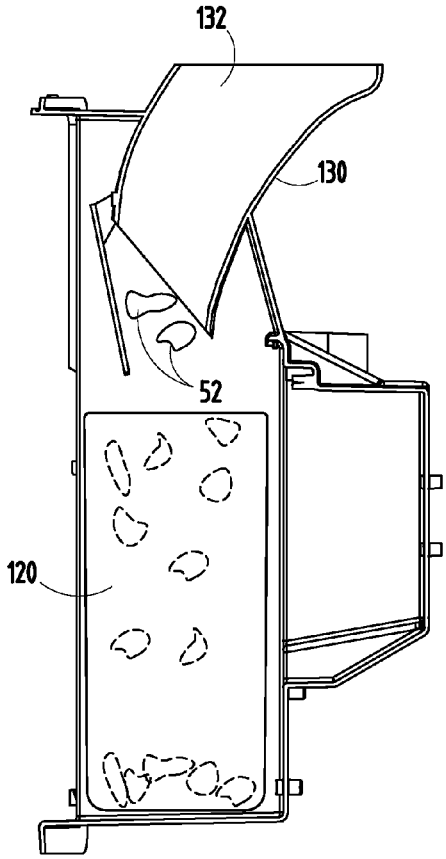
FIG. 22 is a side cross-sectional view of the cup receiving ice from the vertical ice chute.

Referring now to the illustrated embodiment of FIGS. 20-22, an ice dispensing passage 130 that conveys ice 52 from the ice storage unit 58 to the fixed funnel 18 and includes a substantially vertical chute 132. The vertical chute 132 is convex outward and includes a large dispensing aperture for relaying ice 52 from the ice storage unit 58 to the fixed funnel 18. The ice dispensing passage 130 includes a substantially tubular and arcuate construction that minimizes tumbling of ice 52 as the ice 52 cascades down into the cup 120 of a user. Because of the minimized tumbling, the likelihood that ice 52 will break during dispensing is lessened. In addition, the vertical nature of the ice dispensing passage 130, along with the functionality of the variable funnel helps to ensure that dispensed ice 52 falls into the cup 120 and does not miss the cup 120.

The above description is considered that of the illustrated embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. An appliance dispenser comprising:

a housing including a receptacle support member and a fixed funnel;

an ice dispensing passage extending through the fixed funnel and operably connected with an ice bin; and a variable length funnel having a first annular segment concentrically-aligned with a second annular segment and a third annular segment, wherein the third annular segment includes an outer wall, an inner wall, and a bottom wall that define a cavity, and wherein the first annular segment and the second annular segment are received in the cavity;

a first set of downwardly-extending slots disposed in the first annular segment;

a second set of downwardly-extending slots disposed in the second annular segment, wherein the first set of downward-extending slots and the second set of downward-extending slots are aligned with respect to each other; and a plurality of detents disposed in each of the downwardly-extending slots configured to support the third annular segment at a multitude of varying heights.

2. The appliance dispenser of claim 1, wherein a portion of the second annular segment rotates relative to the first annular segment.

3. The appliance dispenser of claim 1, wherein the first, second, and third annular segments are adapted to rotate relative to one another.

4. The appliance dispenser of claim 1, wherein the variable length funnel is connected with a mechanical device operably linked with a controller, the mechanical device being adapted to move the second annular segment between a retracted position and an extended position.

5. The appliance dispenser of claim 4, wherein the mechanical device includes a pressure sensitive transmission device adapted to sense an object in abutting contact with the second annular segment of the variable length funnel.

6. The appliance dispenser of claim 1, wherein the first annular segment and the third annular segment do not rotate relative to one another and are adapted for linear translation relative to one another.

7. An appliance comprising:

an ice bin;

a dispenser adjacent to the ice bin;

a fixed funnel extending from the dispenser;

an extendable length funnel adjacent to the fixed funnel, wherein the extendable length funnel includes a top annular segment with a first set of downwardly-extending slots, an intermediate annular segment with a second set of downward-extending slots, and a bottom annular segment with a third set of downwardly-extending slots, wherein the top annular segment has an outside diameter that is larger than an outside diameter of the intermediate annular segment, and the bottom annular segment has an outside diameter that is larger than both the outside diameter of the top annular segment and the intermediate annular segment, the extendable length funnel being extendable to a plurality of positions;

a plurality of detents disposed in each of the first, second, and third downwardly-extending slots wherein the plurality of detents are configured to secure extendable length funnel at the plurality of positions; and an ice dispensing passage extending from the ice bin through the fixed funnel and extendable length funnel, lengthening the ice dispensing passage when the extendable length funnel is extended.

8. The appliance of claim 7, wherein the extendable length funnel rotates relative to the fixed funnel as the extendable length funnel moves between the plurality of positions.

9. The appliance of claim 7, wherein the top, intermediate, and bottom annular segments are threadably engaged and adapted to rotate relative to one another.

10. The appliance of claim 7, wherein the extendable length funnel is connected with a mechanical device operably linked with a controller, the mechanical device being adapted to move the extendable length funnel between the plurality of positions.

11. The appliance of claim 10, wherein the mechanical device includes a pressure sensitive transmission adapted to sense an object in abutting contact with a distal end of the extendable length funnel.

12. The appliance of claim 7, wherein the extendable length funnel and the fixed funnel do not rotate relative to one another and are adapted for linear translation relative to one another.

13. A dispenser for use on an appliance comprising:

a housing defining a recess, the housing including a receptacle support member and a first funnel;

an ice dispensing passage extending through the first funnel and into operable connection with an ice bin; and a second funnel including a first ring and a second ring each having a distal end, wherein the second ring is operable between an extended position and a retracted position, wherein the distal end of the second ring is closer to the first funnel when in the retracted position than when in the extended position and wherein the second ring has an inner wall and an outer wall separated by a bottom wall to define a cavity configured to receive the first ring, and wherein the first ring includes a plurality of slots having detent features configured to engage detent features on the second ring securing the second ring.

14. The dispenser of claim 13, further comprising:

a motor operably connected with the second funnel and adapted to translate the distal end of the second funnel between the extended position and the retracted position.

* * * * *